US009839953B2

(12) United States Patent
Laib et al.

(10) Patent No.: US 9,839,953 B2
(45) Date of Patent: Dec. 12, 2017

(54) REORIENTABLE ROTATABLE PROCESSING TOOL

(71) Applicants: TRUMPF Werkzeugmaschinen GmbH + Co. KG, Ditzingen (DE); Trumpf, Inc., Farmington, CT (US)

(72) Inventors: Wolfgang Laib, Besigheim (DE); Rainer Hank, Eberdingen/Hochdorf (DE); Martin Steiner, Weil der Stadt (DE); Martin Decker, Vaihingen (DE); Carl Peterhansel, Unionville, CT (US)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 14/104,080

(22) Filed: Dec. 12, 2013

(65) Prior Publication Data

US 2014/0096661 A1 Apr. 10, 2014

Related U.S. Application Data

(60) Division of application No. 12/425,661, filed on Apr. 17, 2009, now Pat. No. 8,627,753, which is a (Continued)

(30) Foreign Application Priority Data

Oct. 18, 2006 (DE) ..... 10 2006 049 044

(51) Int. Cl.
*B21D 37/04* (2006.01)
*B21D 28/36* (2006.01)
(Continued)

(52) U.S. Cl.
CPC ..... *B21D 28/36* (2013.01); *B21D 28/12* (2013.01); *B21D 28/24* (2013.01);
(Continued)

(58) Field of Classification Search
CPC ..... B21D 28/12; B21D 28/24; B21D 28/36; Y10T 83/8732; Y10T 83/8733; Y10T 83/9454; Y10T 83/9423; Y10T 83/8727
(Continued)

(56) References Cited

U.S. PATENT DOCUMENTS 4,103,414 A 8/1978 Herb et al.
4,220,062 A 9/1980 Blanz
(Continued)

FOREIGN PATENT DOCUMENTS

DE 19845585 7/1999
DE 102005005214 8/2006
(Continued)

OTHER PUBLICATIONS

International Search Report and Written Opinion from corresponding PCT Application No. PCT/US2007/081837, dated Feb. 1, 2008, 11 pages.
(Continued)

*Primary Examiner* — Stephen Choi
(74) *Attorney, Agent, or Firm* — Fish & Richardson P.C.

(57) ABSTRACT

A tool includes first and second tool parts that move toward one another, at least one processing device provided on the first tool part, and at least two counter devices provided on the second tool part. The processing device and the counter devices are rotatable relative to one another about at least one positioning axis, and the counter devices are aligned relative to one another along a direction of relative rotational movement of the processing device and the counter devices. The processing device and a first counter device are allocated to one another by at least a first defined processing parameter, and the processing device and a second counter device are allocated to one another by at least a second defined processing parameter. The first processing parameter is different than the second processing parameter.

5 Claims, 5 Drawing Sheets

Related U.S. Application Data continuation of application No. PCT/US2007/081837, filed on Oct. 18, 2007.

(51) Int. Cl.
*B26F 1/14* (2006.01)
*B21D 28/12* (2006.01)
*B21D 28/24* (2006.01)

(52) U.S. Cl.
CPC ..... *Y10T 83/8732* (2015.04); *Y10T 83/8733* (2015.04); *Y10T 83/9454* (2015.04)

(58) Field of Classification Search
USPC ..... 83/549–553, 687
See application file for complete search history.

(56) References Cited

U.S. PATENT DOCUMENTS

| | | | | |
|---|---|---|---|---|
| 4,674,373 | A * | 6/1987 | Kuppinger | 83/49 |
| 4,738,173 | A | 4/1988 | Kiuchi | |
| 5,299,477 | A * | 4/1994 | Miyajima | B21D 28/12 483/28 |
| 5,390,575 | A | 2/1995 | Saito | |
| 7,490,501 | B2 | 2/2009 | Endo | |
| 2002/0088319 | A1 | 7/2002 | Ichikawa | |
| 2004/0154453 | A1 | 8/2004 | Kobayashi | |

FOREIGN PATENT DOCUMENTS

| | | |
|---|---|---|
| EP | 0580124 | 1/1994 |
| EP | 1634663 | 3/2006 |
| GB | 2169233 | 7/1986 |
| JP | 2004122169 | 4/2004 |
| WO | 0243892 | 6/2002 |

OTHER PUBLICATIONS

Notification Concerning Transmittal of International Preliminary Report on Patentability and Written Opinion from corresponding PCT Application No. PCT/US2007/081837, dated Apr. 30, 2009, 8 pages.

* cited by examiner

REORIENTABLE ROTATABLE PROCESSING TOOL

CROSS-REFERENCE TO RELATED APPLICATIONS

This application is a divisional application of and claims priority under 35 U.S.C. §120 to U.S. Ser. No. 12/425,661, filed Apr. 17, 2009, which is a continuation of PCT Application No. PCT/US2007/081837, filed on Oct. 18, 2007 and claims priority under 35 U.S.C. §119(a) to German Application No. 102006049044.4, filed on Oct. 18, 2006, the entire content of both are hereby incorporated by reference.

FIELD

The present invention relates to tools for processing plate-like workpieces, and more specifically to tools having multiple tool parts that can be moved toward one another for processing a workpiece arranged between the multiple tool parts.

BACKGROUND

WO 0243892 A2 provides a tool for forming slots in metal sheets. The tool comprises an upper tool part with a rectangular punch and a lower tool part with a opening adapted to the cross section of the punch. The punch has a cutting edge as a processing device. The cutting edge is inclined on the longitudinal sides of the punch relative to the plane of the metal sheet and on a transverse side of the punch perpendicular to the longitudinal sides. Two counter cutting edges are provided as counter devices on the opening which are arranged respectively on a transverse side and on the longitudinal sides of the opening. At the beginning of the slotting process a strip is cut out which is still joined onto the metal sheet on one side, in that the cutting edge on the punch works together with a counter cutting edge on the opening. During the following slotting process the strip also remains joined to the metal sheet on one side. To cut the strip free, the punch is rotated relative to the opening by 180°. Now the cutting edge on the punch already used at the beginning works together with the second counter cutting edge on the opening. The processing of the workpiece is performed with identical processing parameters for the initial cut stroke and the severing stroke.

SUMMARY

In a first aspect, the present invention features tools for processing plate-like workpieces. The tools include a first tool part and a second tool part, which can be moved towards one another in a direction of travel for processing a workpiece between the first and second tool parts, at least one processing device provided on the first tool part, and at least two counter devices provided on the second tool part. The at least one processing device and the at least two counter devices are rotatable relative to one another about at least one positioning axis, and the at least two counter devices are aligned relative to one another along a direction of relative rotational movement of the at least one processing device and the at least two counter devices. The at least one processing device and a first counter device of the at least two counter devices are allocated to one another by at least a first defined processing parameter, and the at least one processing device and a second counter device of the at least two counter devices are allocated to one another by at least a second defined processing parameter. The first processing parameter is different than the second processing parameter.

In some embodiments, at least one of the first tool part and the second tool part can rotate about a tool rotation axis, the tool rotation axis forming a positioning axis, about which the at least one processing device and the at least two counter devices can be rotated relative to one another.

In some aspects, the at least two counter devices of the second tool part are aligned relative to one another along a circular path about a positioning axis at a distance from the positioning axis, which can be adjusted to a distance of the at least one processing device from the positioning axis.

In certain embodiments, the at least one processing device includes a cutting edge, and at least two counter cutting edges are provided as counter devices on the second tool part.

In some aspects, the at least one processing device includes a cutting edge, and at least two portions of a single counter cutting edge are provided on the second tool part.

In some embodiments, a width of a cutting gap between a cutting edge of the at least one processing device and a counter cutting edge of at least one of the at least two counter devices can vary by allocating a cutting edge to different counter cutting edges as processing parameters.

In certain embodiments, a cutting contour produced by means of a cutting edge of the at least one processing device can vary by allocating the cutting edge to different counter cutting edges as processing parameters.

In some embodiments, the at least one processing device includes a pressure surface, and the at least two counter devices include embossing contours, and an embossed shape produced by interaction of the pressure surface and an allocated embossing contour can vary by allocating the pressure surface to different embossing contours as processing parameters.

In some aspects, the at least one processing device includes a bearing surface, the at least two counter devices include forming surfaces, and a shape produced by interaction of the bearing surface and an allocated forming surface can vary by allocating the bearing surface to different forming surfaces as processing parameters.

In certain embodiments, at least two processing devices are provided on the first tool part, and can be allocated respectively to the at least two counter devices of the second tool part.

In some aspects, at least two processing devices are provided on the first tool part, an activating device being provided for activating the at least one processing device to a functional state. In the functional state, the at least one processing device can project towards the workpiece relative to another processing device during tool processing in the direction of travel.

In some embodiments, at least two processing devices are provided on the first tool part, which can be allocated to a common counter device on the second tool part.

In certain aspects, a support is provided on a base of the first tool part, the support including the at least one processing device, and being rotatably mounted about a support axis.

In some embodiments, a support is provided on a base of the second tool part, the support including at least one counter device, and being rotatably mounted about a support axis.

In further embodiments, at least one support axis forms a positioning axis, about which the at least one processing device and the at least two counter devices can be rotated relative to one another.

In some aspects, the at least one processing device is provided on a tool insert, which is arranged on at least one of a base and a support that is rotatable relative to the base.

In further aspects, at least one counter device is provided on a tool insert, which is arranged on at least one of a base and a support that is rotatable relative to the base.

In still other embodiments, a processing parameter can be defined for preparative processing of a workpiece portion by allocating the at least one processing device to a counter device, and a processing parameter for subsequent processing of the workpiece portion can be defined by allocating the at least one processing device to a different counter device.

In a second aspect, a tool for processing plate-like workpieces includes a first tool part and a second tool part, which can be moved towards one another in a direction of travel for processing a workpiece between the first and second tool parts, at least one processing device provided on the first tool part and including a pressure surface, and at least two counter devices provided on the second tool part and each including an embossing contour, the at least one processing device and the at least two counter devices being rotatable relative to one another about at least one positioning axis, the at least two counter devices being aligned relative to one another along a direction of relative rotational movement of the at least one processing device and the at least two counter devices, the at least one processing device and a first counter device of the at least two counter devices being allocated to one another thus producing a first embossed shape by the interaction of the pressure surface of the at least one processing device and the embossing contour of the first counter device, and the at least one processing device and a second counter device of the at least two counter devices being allocated to one another thus producing a second embossed shape by the interaction of the pressure surface of the at least one processing device and the embossing contour of the second counter device, the first embossed shape being different than the second embossed shape.

In some embodiments, the second aspect can include one or more of the following features: at least one of the first tool part and the second tool part can rotate about a tool rotation axis, the tool rotation axis forming a positioning axis, about which the at least one processing device and the at least two counter devices can be rotated relative to one another; the at least two counter devices of the second tool-part are aligned relative to one another along a circular path about a positioning axis at a distance from the positioning axis, which can be adjusted to a distance of the at least one processing device from the positioning axis; a support is provided on a base of the first tool part, the support including the at least one processing device, and being rotatably mounted about a support axis; the support axis forms a positioning axis about which the at least one processing device and the at least two counter devices can be rotated relative to one another; and the at least two counter devices each are pro-vided on a tool insert, which tool inserts are arranged on a base of the second tool part.

In a third aspect, a tool for rolling plate-like workpieces includes a first tool part and a second tool part, which can be moved towards one another in a direction of travel for rolling a workpiece between the first and second tool parts, wherein the first tool part includes a roller and the second tool part includes a counter roller, the roller of the first tool part and the counter roller of the second tool part being rotatable about rotational axes that extend perpendicularly to the direction of travel of the first tool part and the second tool part, at least one processing device provided on the first tool part and including a conical forming surface, and at least two counter devices provided on the second tool part and each including a conical counter surface, the at least one processing device and the at least two counter devices being rotatable relative to one another about at least one positioning axis, the at least two counter devices being aligned relative to one another along a direction of relative rotational movement of the at least one processing device and the at least two counter de-vices, the conical forming surface included by the at least one processing device and a first conical counter surface included by one of the at least two counter devices being allocated to one another such that there is a first distance between the conical forming surface and the counter surface allocated thereto, and the conical forming surface included by the at least one processing device and a second conical counter surface included by another one of the at least two counter devices being allocated to one another such that there is a second distance between the conical forming surface and the counter surface allocated thereto, the first distance being different than the second distance.

In some embodiments, the third aspect can include one or more of the following features: at least one of the first tool part and the second tool part can rotate about a tool rotation axis, the tool rotation axis forming a positioning axis, about which the at least one processing device and the at least two counter devices can be rotated relative to one another; and the at least two counter devices of the second tool part are aligned relative to one another along a circular path about a positioning axis at a distance from the positioning axis, which can be adjusted to a distance of the at least one processing device from the positioning axis.

In a fourth aspect, a tool for processing plate-like workpieces includes a first tool part and a second tool part, which can be moved towards one another in a direction of travel for processing a workpiece between the first and second tool parts, at least one processing device provided on the first tool part and including a bearing surface, and at least two counter devices provided on the second tool part and each including a forming surface, the at least one processing device and the at least two counter devices being rotatable relative to one another about at least one positioning axis, the at least two counter devices being aligned relative to one another along a direction of relative rotational movement of the at least one processing device and the at least two counter devices, the at least one processing device and a first counter device of the at least two counter devices being allocated to one another thus producing a first shape by the interaction of the bearing surface of the at least one processing device and the forming surface of the first counter device, and the at least one processing device and a second counter device of the at least two counter devices being allocated to one another thus producing a second shape by the interaction of the bearing surface of the at least one processing device and the forming surface of the second counter device, the first shape being different than the second shape.

In some embodiments, the fourth aspect can include one or more of the following features: at least one of the first tool part and the second tool part can rotate about a tool rotation axis, the tool rotation axis forming a positioning axis, about which the at least one processing device and the at least two counter devices can be rotated relative to one another; the at least two counter devices of the second tool-part are aligned relative to one another along a circular path about a positioning axis at a distance from the positioning axis, which can be adjusted to a distance of the at least one processing device from the positioning axis; and the shape produced by the interaction of the bearing surface of the at least one processing device and the forming surface of the first counter device is produced for preparative processing of a workpiece portion and wherein the shape produced by the interaction of the bearing surface of the at least one processing device and the forming surface of the second counter device is produced for subsequent processing of the workpiece portion.

In a fifth aspect, a tool for processing plate-like workpieces includes a first tool part and a second tool part, which can be moved towards one another in a direction of travel for processing a workpiece between the first and second tool parts, at least one processing device provided on the first tool part, and at least two counter devices provided on the second tool part, the at least one processing device and the at least two counter devices being rotatable relative to one another about at least one positioning axis, the at least two counter devices being aligned relative to one another along a direction of relative rotational movement of the at least one processing device and the at least two counter devices, the at least one processing device and a first counter device of the at least two counter devices being allocated to one another thus defining a processing parameter for preparative processing of a workpiece portion, and the at least one processing device and a second counter device of the at least two counter devices being allocated to one another thus defining a processing parameter for subsequent processing of the workpiece portion, the processing parameter for preparative processing of the workpiece portion being different than the processing parameter for subsequent processing of the workpiece portion.

In some embodiments, the fifth aspect can include one or more of the following features: at least one of the first tool part and the second tool part can rotate about a tool rotation axis, the tool rotation axis forming a positioning axis, about which the at least one processing device and the at least two counter devices can be rotated relative to one another; the at least two counter devices of the second tool part are aligned relative to one another along a circular path about a positioning axis at a distance from the positioning axis, which can be adjusted to a distance of the at least one processing device from the positioning axis.

In a sixth aspect, a tool for processing plate-like workpieces includes a first tool part and a second tool part, which can be moved towards one another in a direction of travel for processing a workpiece between the first and second tool parts, wherein the first tool part has a base and a support that is provided on the base and rotatably mounted about a support axis, at least one processing device provided on the support of the first tool part, and at least two counter devices provided on the second tool part, the support of the first tool part including the at least one processing device and the at least two counter devices being rotatable relative to one another about the support axis, the at least two counter devices being aligned relative to one another along a direction of relative rotational movement of the support of the first tool part including the at least one processing device and the at least two counter devices, the at least one processing device provided on the support of the first tool part and a first counter device of the at least two counter devices thus being allocated to one another by at least a first defined processing parameter, and the at least one processing device provided on the support of the first tool part and a second counter device of the at least two counter devices thus being allocated to one another by at least a second defined processing parameter, the first processing parameter being different than the second processing parameter.

In some embodiments, the sixth aspect can include one or more of the following features: the support of the first tool part including the at least one processing device and the at least two counter devices provided on the second tool part are rotatable relative to one another about the support axis by simultaneously rotating the base of the first tool part and the second tool part about the support axis; the at least two counter devices of the second tool part are aligned relative to one another along a circular path about the support axis at a distance from the support axis, which can be adjusted to a distance of the at least one processing device from the support axis; and the at least two counter devices each are provided on a tool insert, which tool inserts are arranged on a base of the second tool part.

In a seventh aspect, a tool for processing plate-like workpieces includes a first tool part and a second tool part, which can be moved towards one another in a direction of travel for processing a workpiece between the first and second tool parts, wherein the second tool part has a base and a support that is provided on the base and rotatably mounted about a support axis, at least one processing device provided on the first tool part, and at least two counter devices provided on the support of the second tool part, the first tool part and the support of the second tool part including the at least two counter devices being rotatable relative to one another about the support axis, the at least two counter devices being aligned relative to one another along a direction of relative rotational movement of the first tool part and the support of the second tool part including the at least two counter devices, the at least one processing device provided on the first tool part and a first counter device of the at least two counter devices provided on the support of the second tool part thus being allocated to one another by at least a first defined processing parameter, and the at least one processing device provided on the first tool part and a second counter device of the at least two counter devices provided on the support of the second tool part thus being allocated to one another by at least a second defined processing parameter, the first processing parameter being different than the second processing parameter.

In an eighth aspect, a method for controlling a tool for processing plate-like workpieces includes determining appropriate processing parameters for processing a plate-like work-piece between two tool parts positioned to receive the workpiece therebetween, based on the determined parameters, determining which of multiple relative rotational positions of the two tool parts is suitable for the processing, adjusting the relative rotational positioning of the two tool parts to position respective portions of the two tool parts opposite one another for cooperative processing of the workpiece between the positioned portions, and then processing the workpiece between the two tool parts, with the tool parts in their adjusted relative rotational positioning.

In a ninth aspect, a machine-readable storage medium contains a set of instructions configured to cause a workpiece processing machine to perform the following steps: determine, based on appropriate processing parameters for processing a plate like workpiece between two tool parts positioned to receive the workpiece therebetween, which of multiple relative rotational positions of the two tool parts is suitable for the processing, adjust the relative rotational positioning of the two tool parts to position respective portions of the two tool parts opposite one another for cooperative processing of the workpiece between the positioned portions, and then processing the workpiece between the two tool parts, with the tool parts in their adjusted relative rotational positioning.

The details of one or more embodiments of the invention are set forth in the accompanying drawings and the description below. Other features, objects, and advantages of the invention will be apparent from the description and drawings, and from the claims.

DESCRIPTION OF DRAWINGS

The invention is explained in more detail in the following with reference to schematic drawings provided by way of example.

Like reference symbols in the various drawings indicate like elements.

DETAILED DESCRIPTION

Figure 1:
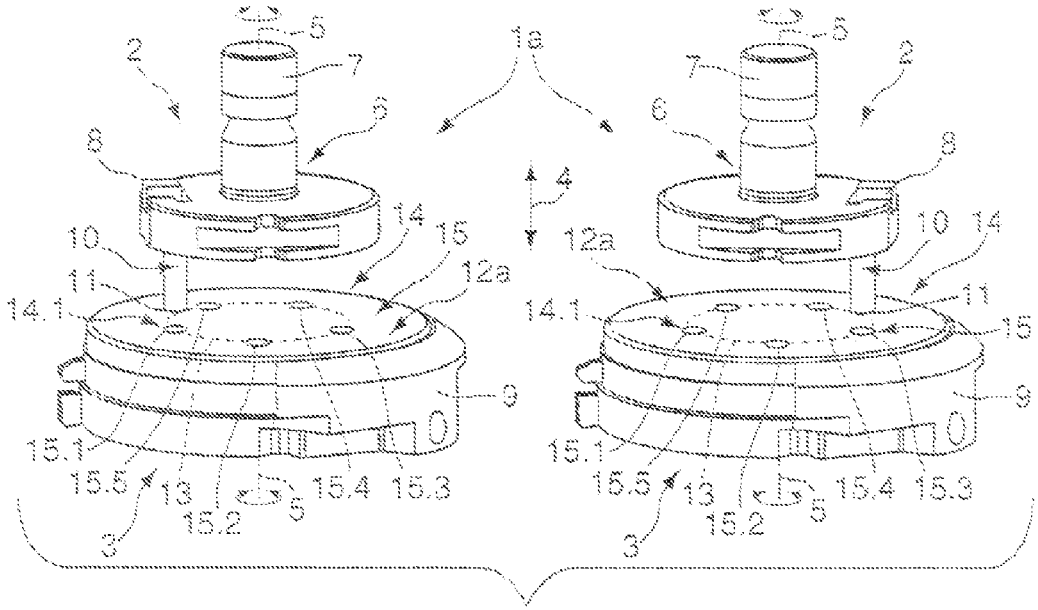
FIG. 1 is a perspective view of a tool of a first type for punching workpieces with two different relative rotational positions of tool parts.

The tools 1*a*, 1*b*, 1*c*, 1*d*, 1*e*, 1*f*, 1*g*, and 1*h* shown in FIGS. 1 to 12 are all provided for use in a conventional numerically controlled base machine for cutting and forming metal sheets. In a machine tool of this kind a first tool part, the upper tool 2, is secured in a machine-side upper tool mount and a second tool part, the lower tool 3, is secured in a machine-side lower tool holder. A metal sheet arranged between the two tool parts is positioned by means of a coordinate guide, supported by a workpiece table arranged next to the lower tool mount, in a horizontal plane between the two tool parts. To process the metal sheet the two tool parts arranged on opposite sides of the metal sheet are moved towards one another by a machine-side lifting drive in a vertical direction of travel 4. The two tool parts can be rotated by means of machine-side rotary drives about a tool rotation axis 5 parallel to the direction of travel 4. In principle, it is possible for the rotation of the tool parts to be performed about different rotary axes. However, the tools 1*a*, 1*b*, 1*c*, 1*d*, 1*e*, 1*f*, 1*g*, and 1*h* are designed for machines in which both tool parts can be rotated about a common tool rotation axis 5.

The upper tool 2 of all shown tools 1*a*, 1*b*, 1*c*, 1*d*, 1*e*, 1*f*, 1*g*, and 1*h* comprises a base 6 with a shaft 7 and an adjusting wedge 8. The shaft 7 is used for securing the upper tool 2 in the machine-side upper tool mounting. In this case the rotational position of the upper tool 2 is determined in relation to the machine-side tool mounting by the adjusting wedge 8. The lower tool 3 has a base 9, which is suitable for being secured in the machine-side lower tool mounting in a defined rotational position.

FIG. 1 shows the tool 1*a* for punching metal sheets. The upper tool 2 and the lower tool 3 are shown in two different relative rotational positions. On the upper tool 2 a hole punch 10 is provided. The hole punch 10 has a circular cutting edge 11 as a processing device.

On the main body 9 of the lower tool 3 a cutting plate 12*a* is provided. On the cutting plate 12*a* along a circular path 13 in the direction of the rotational movement about the tool rotation axis 5 five openings are arranged in succession, which are denoted as a whole by the reference number "14". Each of the openings 14 is delimited by a circular counter cutting edge functioning as a counter device. The counter cutting edges are denoted as a whole by the number "15". Both the cutting edge 11 and the counter cutting edges 15 are arranged to be off-center relative to the tool rotation axis 5. The distance of the cutting edge 11 and the distance of the counter cutting edges 15 from the tool rotation axis 5 are adjusted to one another.

On punching a hole with the tool 1*a* the cutting edge 11 on the upper tool 2 is moved past one of the counter cutting edges 15 of the lower tool 3 in the direction of travel 4. So that the cutting edge 11 can descend into the circular openings 14 in the direction of travel 4 the diameters of the counter cutting edges 15 are larger than the diameter of the cutting edge 11.

In addition, the diameters of the counter cutting edges 15 are different from one another. Depending on which of the counter cutting edges 15 the cutting edge 11 is allocated to, the width of the cutting gap between the cutting edge 11 and the respective counter cutting edge 15.1, 15.2, 15.3, 15.4, and 15.5 is defined to be different. For example, the cutting edge 11 on the hole punch 10 has a diameter of 6.0 millimeters and a circular counter cutting edge 15.1 on an opening 14.1 has a diameter of 6.1 millimeters. The diameters of additional counter cutting edges 15.2, 15.3, 15.4, and 15.5 are 6.2 millimeters, 6.3 millimeters, 6.4 millimeters, and 6.5 millimeters. Thus by means of the interaction of the punch-side cutting edge 11 with the counter cutting edge 15.1 a width of the cutting gap is defined as 0.1 millimeters, by the interaction of the cutting edge 11 with the counter cutting edge 15.2 a width of the cutting gap is defined as 0.2 millimeters etc.

The width of the cutting gap influences to a great extent the quality of the result of processing. In this way the width of the cutting gap is changed for example depending on the thickness of the metal sheet to be processed. In the aforementioned case by means of the interaction of the cutting edge 11 with the counter cutting edge 15.1 a metal sheet can be processed with a thickness of 1.0 millimeters, whereas by combining the cutting edge 11 with the counter cutting edge 15.2 a metal sheet with a thickness of 1.5 millimeters can be punched with comparable cut quality. Generally, with one and the same tool metal sheets of varying thicknesses can be processed with uniform quality.

The cutting edge 11 can be allocated to one of the counter cutting edges 15 in a simple manner by a relative rotational movement of the cutting edge 11 on the one hand and the counter cutting edges 15 on the other hand. The positioning axis about which the cutting edge 11 and the counter cutting edges 15 can be rotated relative to one another is in this case formed by the common tool rotation axis 5. The upper tool 2 can be rotated alone about the tool rotation axis 5 relative to the lower tool 3 and the lower tool 3 can be rotated alone relative to the upper tool 2. However, a change in the allocation can be achieved by superimposing rotational movements of the two tool parts about the tool rotation axis 5.

In the left part of FIG. 1 the cutting edge 11 is assigned to the counter cutting edge 15.1, in the right part to the counter cutting edge 15.3. To move the tool 1*a* from the former rotational position thereto rotational position in the example shown a rotational movement of the upper tool 2 relative to the lower tool 3 is performed about the tool rotation axis 5, until the cutting edge 11 is aligned in the direction of travel 4 above the counter cutting edge 15.3.

Figure 2:
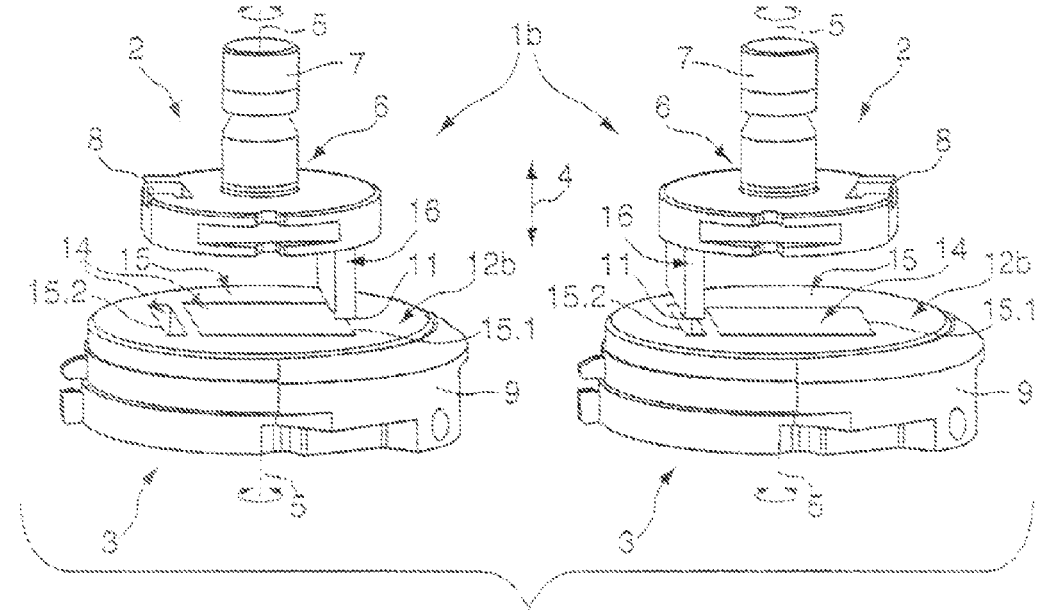
FIG. 2 is a perspective view of a tool of a second type for punching workpieces with two different relative rotational positions of tool parts.

FIG. 2 shows a tool 1*b* of a second type for punching metal sheets. A rectangular punch 16 provided on the base 6 of the upper tool 2 comprises a rectangular cutting edge 11 on its lower end as a processing device. The cutting edge 11 is arranged off-centre in relation to the rotation axis 5 of the upper tool 2.

On a cutting plate 12*b* of the lower tool 3 two rectangular openings 14 are provided. The larger of the openings 14 is only delimited on one side by a counter cutting edge 15.1 acting as a counter device, whereas the smaller of the openings 14 is surrounded by a rectangular counter cutting edge 15.2 acting as an additional counter device. The counter cutting edges are denoted as a whole by the reference number "15".

The cutting edge 11 on the rectangular punch 16 of the upper tool 2 can, as shown in the left part of FIG. 2, be allocated to the counter cutting edge 15.1 on the larger of the openings 14. By means of a relative rotational movement of the upper tool 2 and the lower tool 3 about the tool rotation axis 5, according to the right part of FIG. 2, the cutting edge 11 of the upper tool 2 is allocated to the counter cutting edge 15.2 on the smaller opening 14 of the lower tool 3. In this way the tool rotation axis 5 forms a positioning axis about which the cutting edge 11 and the counter cutting edges 15 can be rotated relative to one another.

If the tool 1*b* is located in the position shown in the left part of FIG. 2, on the working movement of the tool parts in the direction of travel 4 a straight cut is produced in the workpiece, as in this case only a portion of the cutting edge 11, namely the straight portion, which is arranged externally in radial direction relative to the tool rotation axis 5, can interact with the counter cutting edge 15.1.

In the conditions according to the right part of FIG. 2 however a rectangular region can be punched out of the sheet, as here the entire cutting edge 11 of the upper tool 2 interacts with the counter cutting edge 15.2 of the lower tool 3.

The processing device is formed in the case of tool 1*b* by the rectangular cutting edge 11. Depending on the relative rotational position of the tool parts of tool 1*b* the cutting edge 11 is allocated as a counter device to the counter cutting edge 15.1 or the counter cutting edge 15.2. As a processing parameter the cutting contour produced by means of the cutting edge 11 can be defined differently.

It is also possible with tool 1*b* to eject relatively large workpieces, punched out of the composite metal sheet, through the larger of the openings 14 from tool 1*b*. If a freely punched workpiece, once it has been cut by the tool 1*b* from the composite metal sheet, lies completely over the larger of the openings 14, it can pass down through the latter, provided it is the appropriate size. Alternatively, the freely punched tool can also be cut out of the composite metal sheet aligned relative to the lower tool 3, so that it does not lie over the larger of the openings 14.

Figure 3:
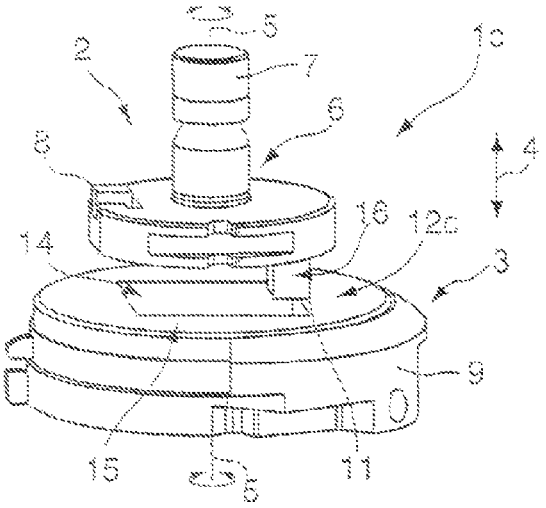
FIG. 3 is a perspective view of a tool of a third type for punching workpieces.
Figure 4:
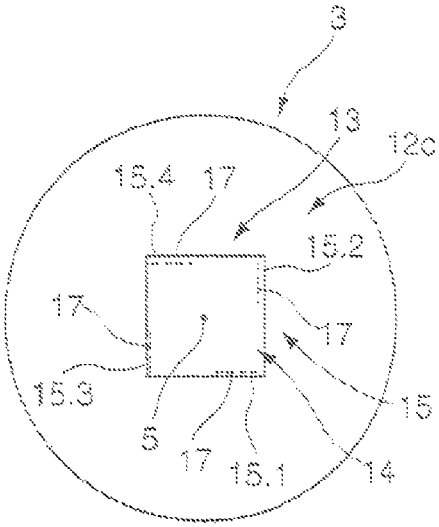
FIG. 4 is the lower part of the tool according to FIG. 3 in a plan view.

FIGS. 3 and 4 show the tool 1*c* for punching metal sheets. The tool 1*c* coincides in structure largely with the tools 1*a*, 1*b* according to FIGS. 1 and 2. However, the processing device of the upper tool 2 and the counter devices of the lower tool 3 have been modified. In the case of tool 1*c* according to FIG. 3 a single straight cutting edge 11 on a rectangular punch 16 of the upper tool 2 acts as a processing device. As counter devices four straight counter cutting edges 15.1, 15.2, 15.3, and 15.4 are arranged on the circumference of a rectangular opening 14 of a cutting plate 12*c*. The reference number "15" is allocated overall to the four counter cutting edges 15.1, 15.2, 15.3, and 15.4.

As a function of the relative rotational position of the upper tool 2 and lower tool 3 about the tool rotation axis 5 the cutting edge 11 is allocated to one of the four counter cutting edges 15.

In FIG. 4 the dashed lines 17 show a projection of the cutting edge 11 of the upper tool 2 in the various relative rotational positions of the cutting edge 11 and the counter cutting edges 15. In the various relative rotational positions the distance between the cutting edge 11 and the counter cutting edge 15.1, 15.2, 15.3, and 15.4 of the counter cutting edges 15 allocated thereto are different. In this way the width of the cutting gap is variable as a processing parameter.

Figure 5:
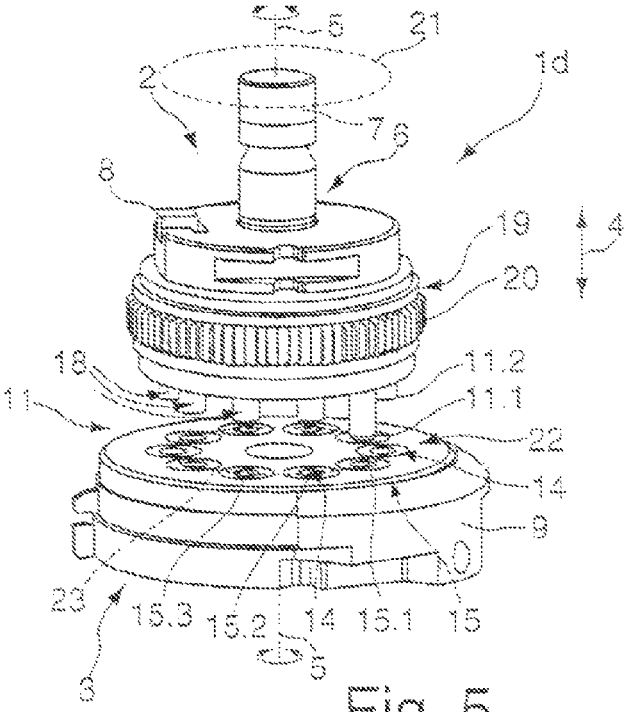
FIG. 5 is a perspective view of a tool of a fourth type for punching workpieces.
Figure 6:
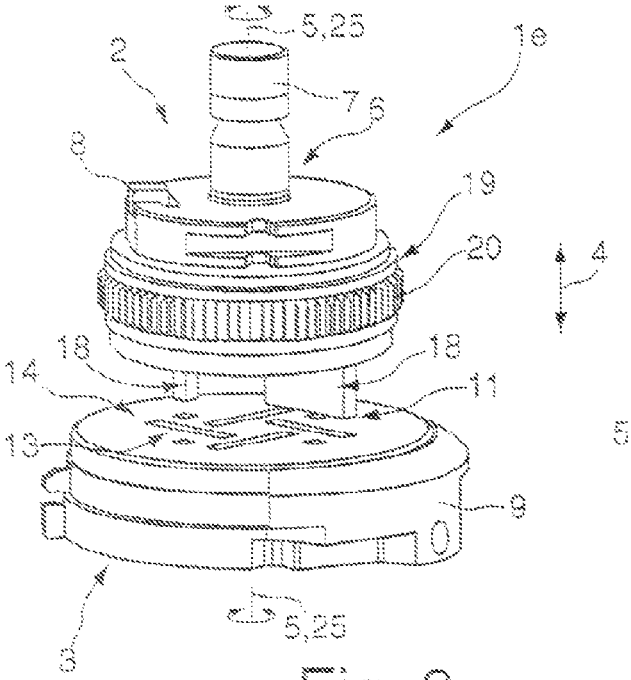
FIG. 6 is a perspective view of a tool of a fifth type for punching workpieces.
Figure 7:
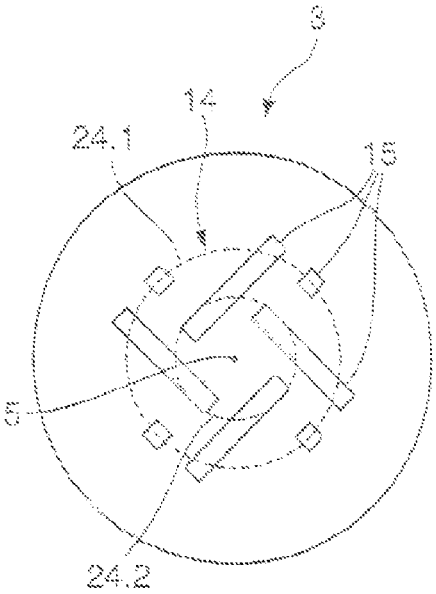
FIG. 7 is the lower part of the tool according to FIG. 6 in a plan view.

FIGS. 5 to 7 relate to the tools 1*d*, 1*e* for punching metal sheets, which on the upper tool part comprise respectively at least two individually activatable processing devices. Tools of this kind are also known as multiple tools or multitools.

Both tools 1*d*, 1*e* have rotating cutting edges 11 on several punch inserts 18 as processing devices. For processing the workpiece only one of the punch inserts 18 is ever moved into a functional position. The respective punch insert is activated by means of an activating device of known design integrated into the upper tool 2. Depending on the relative rotational position of an activating element 19 relative to the base 6 of the upper tool 2 supporting the punch inserts 18, one of the punch inserts 18 protrudes relative to one or the other in the direction of travel 4.

To change its rotational position relative to the base 6 the activating element 19 on the external circumference comprises a toothing 20. A machine-side pinion engaging in the toothing 20, which is not shown for reasons of simplicity, enables on rotation of the base 6 about the tool rotation axis 5 either a rotation of the activating element 19 at the same time as the base 6 or obstructs the activating element 19 in a joint rotary movement with the base 6. If the activating element 19 is obstructed in a rotary movement with the base 6, the rotation of the base 6 causes a rotation of the base 6 relative to the activating element 19. The rotation angle is selected so that the desired punch insert is activated.

The tool 1*d* according to FIG. 5 has ten individually replaceable punch inserts. The cutting edges 11 are arranged in succession along a circular path 21 about the tool rotation axis 5. On the lower tool 3 die inserts 22 are provided. A total of ten individually replaceable die inserts follow a circular path 23 about the tool rotation axis 5. The die inserts 22 comprise circular openings 14 which are delimited by circular counter cutting edges 15 each forming a counter device respectively. The distance of the cutting edges 11 from the tool rotation axis 5 and the distance of the counter cutting edges 15 from the tool rotation axis 5 are adjusted to one another.

The punch inserts 18 of the upper tool 2 and thereby the cutting edges 11 arranged on the punch inserts 18 can be activated individually by means of the activating device for processing the workpiece. An activated punch insert, i.e. located in a functional position, can be allocated each of the die inserts 22 by rotation of the upper tool 2 and the lower tool 3 relative to one another about the tool rotation axis 5. Thus even with tool 1*d* the tool rotation axis 5 forms a positioning axis, about which the cutting edges 11 and the counter cutting edges 15 can be rotated relative to one another.

With ten different punch inserts 18 and ten different die inserts 22, as shown in FIG. 5, a hundred different combinations are possible. In practice however, it is not always practical to design the tool 1*d* so that all possible combinations for processing the workpiece can actually be used. For example, five of the cutting edges 11 have a diameter of 6.0 millimeters, 6.2 millimeters, 6.4 millimeters, 6.8 millimeters, and 7.0 millimeters. The diameters of five of the counter cutting edges 15 are 6.1 millimeters, 6.3 millimeters, 6.5 millimeters, 6.9 millimeters, and 7.1 millimeters. The cutting edge 11.1 with a diameter of 7.0 millimeters can in practice only be allocated to the counter cutting edge 15.1 with a diameter of 7.1 millimeters, as all of the other counter cutting edges 15 have a diameter that is too small. To process a metal sheet with a sheet thickness of 1.0 millimeters the cutting edge 11.2 with a diameter of 6.0 millimeters must interact with the counter cutting edge 15.2 with a diameter of 6.1 millimeters. In this case the width of the cutting gap is defined as 0.1 millimeters. For processing a metal sheet with a sheet thickness of 3.0 millimeters the width of the cutting gap has to be set to 0.3 millimeters, the cutting edge 11.2 consequently has to be allocated to the counter cutting edge 15.3 with a diameter of 6.3 millimeters.

The tool 1*e*, also in the form of a "multitool," is shown in FIGS. 6 and 7. Contrary to tool 1*d* tool 1*e* only has two individually exchangeable punch inserts. The cutting edges 11 of which also enclose different contours. The tool 1*e* is also equipped with an activating device, which makes it possible to move one of the punch inserts 18 and the cutting edges 11 arranged thereon into a functional position for processing the workpiece.

The two punch inserts 18 and the cutting edges 11 arranged thereon are arranged off-centre relative to the tool rotation axis 5, but are a different distance from the tool rotation axis 5.

FIG. 7 shows the lower tool 3 of the tool 1*e* in plan view. As shown in FIG. 7 four of the openings 14 can be allocated to each of the punch inserts 18. The openings 14 are arranged in succession on two circular paths 24.1, 24.2 about the tool rotation axis 5. The two circular paths 24.1, 24.2 have different diameters to correspond with the different distances of the punch inserts 18 from the tool rotation axis 5. By means of this arrangement of the openings 14 offset in radial direction the installation space available on the lower tool 2 for openings 14 can be used to an optimum degree.

Also the cutting edges 11 and the allocatable counter cutting edges 15 on the tool 1*e* are configured so that by allocating the cutting edges 11 to different counter cutting edges 15 the width of the cutting gap is defined differently as a processing parameter.

Figure 8:
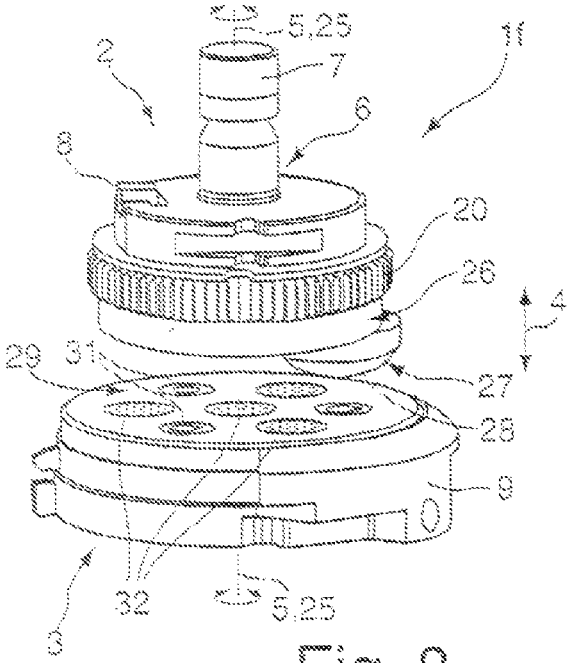
FIG. 8 is a perspective view of a tool for embossing workpieces.
Figure 9:
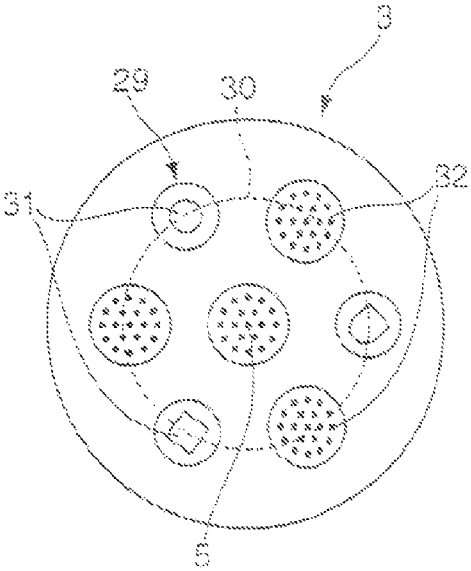
FIG. 9 is the lower part of the tool according to FIG. 8 in a plan view.

FIGS. 8 and 9 show a tool if for embossing metal sheets. The upper tool 2 of tool if comprises a support 26 that is rotatable relative to the base 6 of the upper tool 2 about a support axis 25. The support axis 25 corresponds with the tool rotation axis 5. Toothing 20 is provided on the outer circumference of the support 26. By means of a machine-side pinion engaging with the toothing 20 a rotational movement of the support 26 relative to the base 6 of the upper tool 2 is controlled, comparable to the activating rotational movement of the activating element 19 of tools 1*d*, 1*e* according to FIGS. 5 to 7.

In contrast to the tools 1*d*, 1*e* the processing device, a pressure surface 28 provided on a pressure element 27 is not attached directly onto the base 6 of the upper tool 2 but onto the support 26 that is rotatable relative to the base 6. With a rotation of the base 6 about the tool rotation axis 5 the machine-side pinion either permits a rotation of the support 26 at the same time as the base 6 or prevents the support 26 from making a common rotational movement with the base 6. In this way the pressure surface 28 also rotates either with the base 6 or the base 6 performs a rotational movement relative to the pressure surface 28. Upon a rotational movement of the base 6 relative to the pressure surface 28 forming a processing device a relative rotational movement of the processing device is performed on the upper tool 2 relative to the counter devices on the lower tool 3, in that the lower tool 3 is rotated by means of the machine-side rotary drive of the lower tool 3 to the same extent as the base 6 of the upper tool 2. The lower tool 3 together with the counter devices provided thereon thus performs a rotational movement relative to the standing support 26 and the processing device provided on the support 26. Advantageously, to produce the relative rotational movement of the processing device and counter devices it is not necessary for the upper tool 2 and the lower tool 3 to perform independent rotational movements. It may be sufficient for both tool parts to be rotated only simultaneously about the tool rotation axis 5. In this way it is easier to control the rotary drives of the tool parts.

As shown in FIG. 9 on the base 9 of the lower tool 3 individually replaceable embossing inserts 29 are arranged in succession along a circular path 30 in the direction of the relative rotation movement about the tool rotation axis 5. Embossing contours 31 on the embossing inserts 29 with different shapes project from the base 9 of the lower tool 3 in the direction of travel 4.

Between the embossing inserts 29 brush inserts 32 are provided, the brushes of which project over the embossing contours 31 in the direction of travel 4. The brush inserts 32 are used as a resilient tool bearing for the metal sheet to be processed.

Depending on the relative rotational position of the pressure surface 28 and the embossing contours 31 about the support axis 25 or the workpiece rotational axis 5 coinciding with the support axis 25 the pressure surface 28 is allocated to one of the embossed contours 31.

To process a workpiece the upper tool 2 and the lower tool 3 are moved towards one another in the direction of travel 4. Firstly, the brush inserts 32 ensure that the underside of the workpiece is spaced apart from the embossing contours 31. The pressure exerted by the pressure surface 28 on the workpiece means that the workpiece is pressed against the elastic force of the brushes in the region below the pressure surface 28 downwards against the embossing contour arranged there. In this way the respective embossed shape is made in the underside of the workpiece. When the pressure is lifted from the workpiece the brush inserts 32 push the workpiece upwards. As a result the underside of the workpiece lifts up again from the embossing contours 31 in the direction of travel 4. After allocating the pressure surface 28 to a different embossing contour a different embossed shape can be made in the workpiece.

An alternative, not shown design of a forming tool is used for forming extrusions in metal sheets. The tool corresponds structurally largely to the tools 1*a*, 1*b*, 1*c*, 1*d*, 1*e*, and 1*f* described above. Essentially the extrusion tool differs from the tools 1*a*, 1*b*, 1*c*, 1*d*, 1*e*, and 1*f* described above in that it comprises a processing device on a first tool part in the form of a extrusion pin and two counter devices on a second tool part which are designed as extrusion cups.

The extrusion pin and the cups are arranged in such a way that the pin can be allocated by a relative rotational movement of the pin and cups about the tool rotation axis to different extrusion cups. In the actual forming process the extrusion pin and the inside of a extrusion cup have a forming effect on the metal sheet. Depending on the internal dimensions of the extrusion cup on the metal sheet a pushed-through hole is produced with varying dimensions. Accordingly by allocating the extrusion pin with cups to extrusion cups with different internal dimensions as processing parameters, the dimensions of the pushed-through hole produced can be defined to be different.

The internal dimensions of the extrusion cups can be selected so that with the extrusion tool by allocation of the extrusion pin to different extrusion cups it is possible to process metal sheets of different thicknesses. In this case it should be taken into account that the internal dimensions of the extrusion cups also have to increase with increasing sheet thickness.

Figure 10:
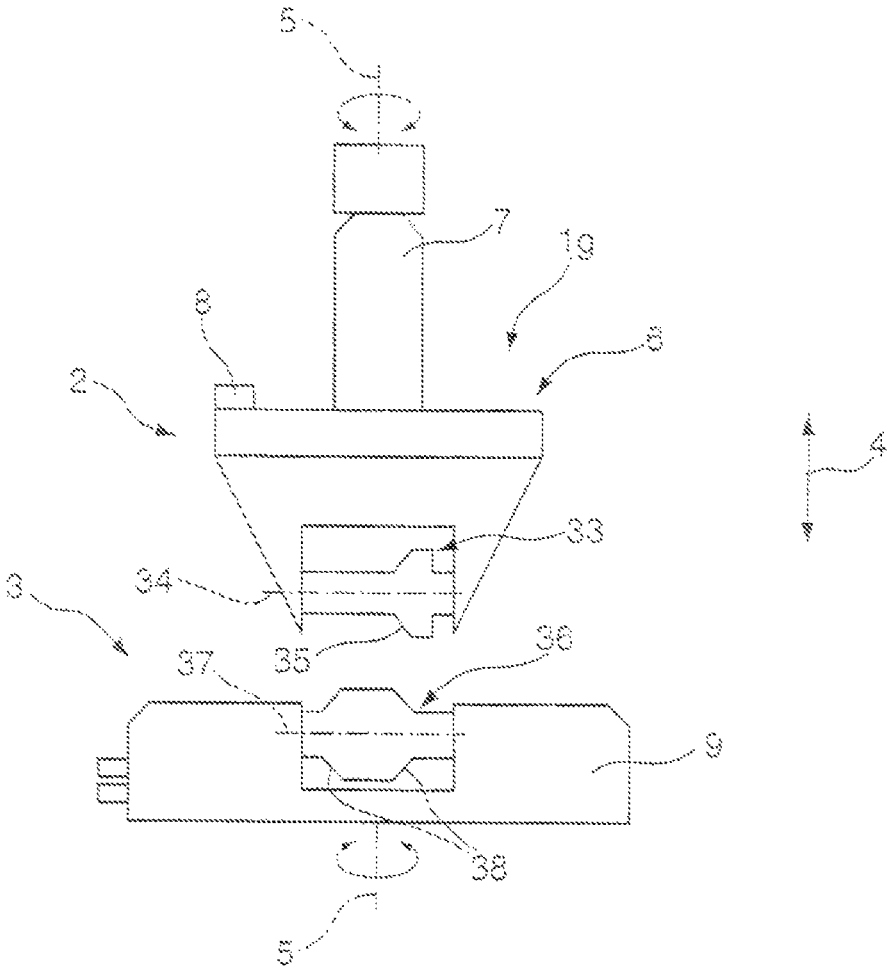
FIG. 10 is a schematic cross section of a tool for rolling workpieces.

FIG. 10 shows a schematic cross section view of a tool 1*g* for rolling a metal sheet in a cutting plane containing the tool rotation axis 5. The upper tool 2 comprises a roller 33, which is rotatable about a rotational axis 34 perpendicular to the lifting direction 4. The roller 33 has a conical forming surface 35 as a processing device. On the lower tool 3 a counter roller 36 is provided. The counter roller 36 is rotatable about a rotational axis 37, which is aligned to be parallel to the rotational axis 34 of the roller 33 of the upper tool 2. On the counter roller 36 two conical counter surfaces 38 are provided as counter devices.

To process a metal sheet the upper tool 2 and the lower tool 3 are moved towards one another in the direction of travel 4 until the metal sheet to be processed is clamped between the roller 33 and the counter roller 36. In the clamped state the forming surface 35 of the roller 33 and the opposite counter surface 38 of the counter roller 36 in the direction of travel 4 interact. By moving the metal sheet in a horizontal plane between the two tool parts a shoulder is created on the metal sheet in a continual operation.

Prior to processing the workpiece the forming surface 35 can be allocated to one of the two counter surfaces 38 by a relative rotational movement of the forming surface 35 and the counter surfaces 38 about the tool rotation axis 5. In the case of the tool 1*g* the distances between the two counter surfaces 38 from the tool rotation axis 5 differ. In this way the distance between the forming surface 35 and the counter surface 38 allocated thereto are different, depending on which of the two counter surfaces 38 of the lower tool 3 the forming surface 35 of the upper tool 2 is allocated to. The different distances are selected to that by changing the allocation of forming surface 35 and counter surface 38 metal sheets of different thicknesses can be processed.

Figure 11:
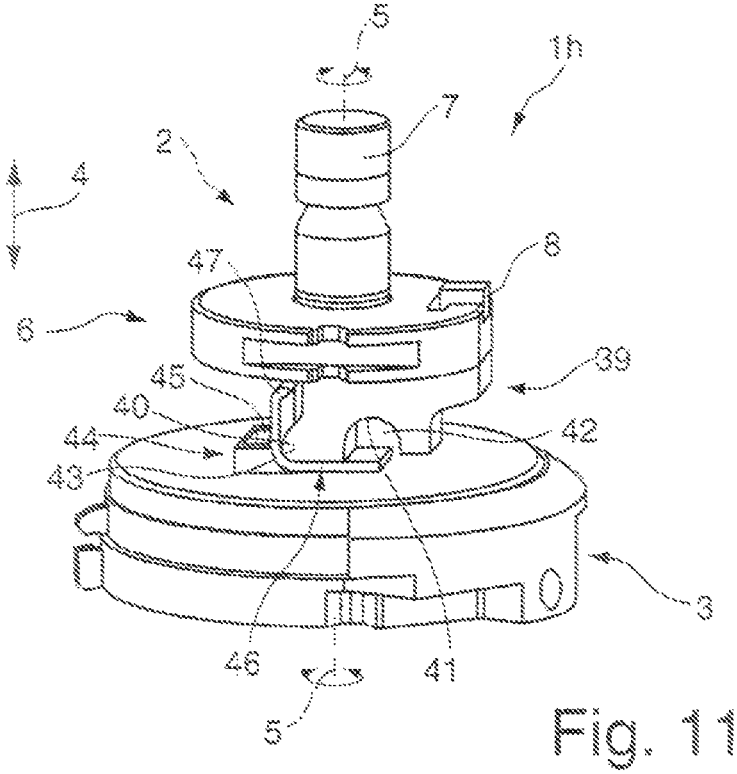
FIG. 11 is a perspective view of a tool for producing a hinge case.
Figure 12:
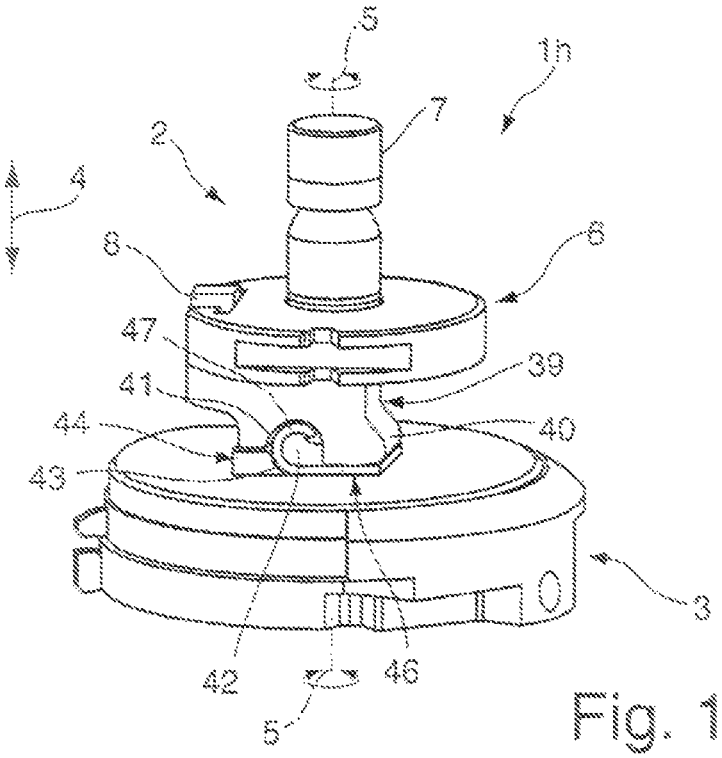
FIG. 12 is the tool for producing a hinge case according to FIG. 11 in a different relative rotational position of tool parts.

FIGS. 11 and 12 show a tool 1*h* for forming a metal sheet, in particular for producing a hinge case on a metal sheet with two different relative rotational positions of the upper tool 2 and lower tool 3 of tool 1*h*. The upper tool 2 comprises a pressure punch 39 with two counter devices in the form of forming surfaces 40 and 41. The forming surface 40 is provided on a punch nose of the pressure punch 39. The forming surface 41 is formed by a casing surface of a semicircular recess 42 of the pressure punch 39. The forming surfaces 40, 41 follow in succession in the direction of a rotational movement about the tool rotation axis 5.

The lower tool 3 of tool 1*h* has a bearing surface 43 as a processing device, which during the processing of a workpiece depending on the relative rotational position of the tool parts works together with one of the forming surfaces 40, 41. The bearing surface 43 is provided on a bearing block 44 which in turn comprises a recess 45 that is open at the top.

In FIGS. 11 and 12 an area of the metal sheet to be processed is shown in the form of metal strip 46 with a metal sheet lug 47. To produce a hinge case in a preparatory stage the previously partly cut sheet metal lug 47 is bent upwards by means of the tool 1*h* in the relative rotational position of the tool parts according to FIG. 11 with the interaction of the bearing surface 43 and the forming surface 40.

Firstly, the upper tool 2 is lifted from the position shown in FIG. 11. Afterwards it is rotated relative to the lower tool 3 about the tool rotation axis 5 until the bent upwards sheet metal lug 47 projects into the semi-circular recess 42 of the pressure punch 39. With tool 1*h* a rotation of the upper tool 2 about 180° is required. The sheet metal lug 47 meanwhile remains on the bearing surface 43. Afterwards by lowering the upper tool 2 the sheet metal lug 47 is formed to a hinge case by means of the forming surface 41 on the casing surface of the semicircular recess 42 and by means of the bearing surface 43, whereby a part of the pressure punch 39 is lowered into the recess 45 of the bearing block 44.

According to the allocation of the bearing surface 43 to one of the forming surfaces 40, 41 as processing parameters the shape to be achieved can be defined differently.

The tools 1*a*, 1*b*, 1*c*, 1*d*, 1*e*, 1*f*, 1*g*, and 1*h* described above are moved towards one another for tool processing by means of a not-shown, machine-side lifting drive in the direction of travel 4. Furthermore, the two tool parts are rotated respectively by means of also not shown, machine-side rotary drives about the tool rotation axis 5 and secured in the respective relative rotational position. The movement of the workpiece relative to the tool parts is performed by means of a coordinate guide of the tool machine. To control all of the aforementioned drives of the tool machine a numerical control unit is used.

To allocate to one another a processing device and a counter device of one of the tools 1*a*, 1*b*, 1*c*, 1*d*, 1*e*, 1*f*, 1*g*, and 1*h* for processing a workpiece, the tool rotary drives are controlled by the control unit so that the necessary relative rotational position of the tool part is produced. In the case of a multiple tool the desired processing device for processing a workpiece is also activated by the control unit.

Advantageously, the numerical control unit comprises storage means in which information about the tool, in particular the possible relative rotational positions of the tool parts are stored. Furthermore, for each relative rotational position of the processing and contour devices the processing parameters are stored, which are defined by said relative rotational position. On the basis of processing parameters provided in a processing program the control unit can determine the tool suitable for the respective workpiece processing by referring to the stored tool information and if necessary ensure that the suitable tool is inserted by means of a tool changing device. Furthermore, by means of the control unit the corresponding relative rotational position of the tool parts can be adjusted automatically.

Other Embodiments

A number of embodiments of the invention have been described. Nevertheless, it will be understood that various modifications may be made without departing from the spirit and scope of the invention.

What is claimed is:

1. A tool for processing plate-like workpieces, comprising:

a first tool part and a second tool part, which are movable towards one another in a direction of travel for processing a workpiece between the first and second tool parts:

the first tool part comprising a first cutting edge having a square-shaped cutting edge contour, and a second cutting edge having a rectangle-shaped cutting edge contour, the second tool part comprising a first set of counter cutting edges and a second set of counter cutting edges, the first set of counter cutting edges comprising counter cutting edges having a square-shaped counter cutting edge contour that corresponds to the square-shaped cutting edge contour of the first cutting edge for workpiece processing, and the second set of counter cutting edges comprising counter cutting edges having a rectangle-shaped counter cutting edge contour that corresponds to the rectangle-shaped cutting edge contour of the second cutting edge for workpiece processing; and an activating device being provided for activating one of the first cutting edge and the second cutting edge to a functional state to provide the one of the first cutting edge and the second cutting edge as a projecting cutting edge that projects towards the workpiece relative to the other of the first cutting edge and the second cutting edge during processing of the workpiece in the direction of travel, wherein:

the projecting cutting edge in the functional state and a corresponding set of counter cutting edges that match a shape of the cutting edge contour of the projecting cutting edge in the functional state are rotatable relative to one another about a positioning axis, the counter cutting edges of the corresponding set of counter cutting edges being aligned relative to one another along a direction of relative rotational movement of the projecting cutting edge in the functional state and the corresponding set of counter cutting edges, the projecting cutting edge in the functional state and a first counter cutting edge of the corresponding set of counter cutting edges being allocated to one another to define a first cutting gap having a first width between the projecting cutting edge in the functional state and the first counter cutting edge, and the projecting cutting edge in the functional state and a second counter cutting edge of the corresponding set of counter cutting edges being allocated to one another to define a second cutting gap having a second width between the projecting cutting edge in the functional state and the second counter cutting edge, the first width being different from the second width.

2. The tool of claim 1, wherein at least one of the first tool part and the second tool part are rotatable about a tool rotation axis, the tool rotation axis forming the positioning axis, about which the projecting cutting edge in the functional state and the corresponding set of counter cutting edges are rotatable relative to one another.

3. The tool of claim 1, wherein the counter cutting edges of the first set of counter cutting edges of the second tool part are aligned along a circular path about the positioning axis at a first distance from the positioning axis, which corresponds with a first radial distance of the projecting first cutting edge of the first tool part in the functional state from the positioning axis and wherein the counter cutting edges of the second set of counter cutting edges of the second tool part are aligned along a circular path about the positioning axis at a second distance from the positioning axis, which corresponds with a second radial distance of the projecting second cutting edge of the first tool part in the functional state from the positioning axis.

4. The tool of claim 1, wherein each of the first cutting edge and the second cutting edge are provided on a tool insert, which tool inserts are arranged on a base of the first tool part.

5. The tool of claim 1, wherein each counter cutting edge of the first set of counter cutting edges and of the second set of counter cutting edges is provided on a tool insert, which tool inserts are arranged on a base of the second tool part.

* * * * *